United States Patent [19]

Skillius

[11] Patent Number: 4,982,863

[45] Date of Patent: Jan. 8, 1991

[54] PORTABLE BOX

[75] Inventor: Hans Skillius, Halmstad, Sweden

[73] Assignee: A/S E. Danberg Group, Nykobing F, Denmark

[21] Appl. No.: 496,978

[22] Filed: Mar. 20, 1990

[30] Foreign Application Priority Data

Mar. 22, 1989 [DK] Denmark ..... 337/1989
Sep. 21, 1989 [DE] Fed. Rep. of Germany ... 8911266[U]

[51] Int. Cl.[5] ..... A65D 25/28

[52] U.S. Cl. ..... 220/318; 220/94 R; B65D/25/28

[58] Field of Search ..... 220/322, 315, 94 R, 220/318

[56] References Cited

U.S. PATENT DOCUMENTS

| | | | |
|---|---|---|---|
| 3,572,870 | 3/1971 | Marks | 220/94 R |
| 3,756,451 | 9/1973 | Popeil | 220/94 R |
| 4,058,210 | 11/1977 | Mitchell | 220/94 R |
| 4,216,862 | 8/1980 | Daenen | 220/94 R |
| 4,592,482 | 6/1986 | Seager | 220/94 R |

*Primary Examiner*—Joseph M. Moy

*Attorney, Agent, or Firm*—Mason, Fenwick & Lawrence

[57] ABSTRACT

A portable box comprises a box body including a bottom and a circumferential, upright wall defining at its upper rim an opening, a cover closing the opening as well as a handle means in form of a preferably hoop-shaped handle. The handle is pivotally hinged relative to the box body and the cover, a locking device being provided in the hinged area of said handle, where said locking device allows an opening or closing of the cover of the box body in a first portion of the turning movement of the handle and in other portions of said turning movement prevents an opening of the cover. The handle is pivotally hinged to the cover, and the locking device comprises two aligned locking protrusions projecting from their respective opposing wall portion and two aligned locking means associated with the handle and situated at their respective end of the cover, said two locking means comprising a hollow interior receiving the corresponding locking protrusion and further comprising a radial slot allowing an insertion of the locking protrusion into said locking means when the handle is situated in said first portion of its turning movement.

6 Claims, 2 Drawing Sheets

PORTABLE BOX

FIELD OF THE INVENTION

The invention relates to a portable box comprising a box body including a bottom, a circumferential wall defining at its upper rim an opening, a cover closing the opening as well as a handle means in form of a preferably hoop-shaped handle pivotally hinged relative to the box body and the cover, a locking device being provided in the hinged area of said handle, where said locking device allows an opening or closing of the cover of the box body in a first portion of the turning movement of the handle and in other portions of said turning movement prevents an opening of the cover.

BACKGROUND ART

A portable box of the above type is known, said box being used as a cooling box. The locking device of the known box is, however, rather complicated structured and the handle thereof is pivotally hinged to the box body.

Summary of the Invention

Accordingly it is an object of the present invention to provide a box of the above type and comprising a simple and reliable locking means for the securing of the cover to the box body.

In satisfaction of the foregoing object and advantages there is provided by the present invention a box, wherein the handle is pivotally hinged to the cover, and wherein the locking device comprises two aligned locking protrusions projecting from their respective opposing wall portion and two aligned locking means associated with the handle and situated at their respective end of the cover, said two locking means comprising a hollow interior receiving the corresponding locking protrusion and further comprising a radial slot allowing an insertion of the locking protrusion into said locking means when the handle is situated in said first portion of its turning movement. The resulting box comprises a very simple locking device which in a first portion of the turning movement of the handle allows the looking means associated with the handle to engage the corresponding pins on the box body, and thereafter by turning the handle into another portion of its turning movement said locking device ensures simultaneously a reliable securing of the cover and of the handle to the box body.

According to an advantageous embodiment of the invention the slot of the locking means is shaped such that the corresponding locking protrusion can be inserted therein when the handle has been turned substantially 45° relative to the horizontal plane with the result that the cover and the handle are simultaneously reliably secured to the box, both when said box is carried by the handle and when the handles have been turned down so as to abut the cover, i.e. in the storing position of the box.

In addition according to the invention the locking protrusions are substantially triangular with the point facing upwards when seen in the cross-sectional direction, whereby the insertion of said locking means into engagement with the locking protrusions has been facilitated.

Moreover according to the invention the locking means comprises one or more projections on the outside, said projections co-operating with a resilient ratchet means connected to the cover, whereby both a physically perceptible and optionally audible indication is achieved of which portion the handle has reached in its turning movement.

Furthermore according to the invention the handle is hinged to the cover by means of a pivot projecting from each end of the cover and a corresponding bearing housing at the corresponding ends of the handle, and each bearing housing comprises an axially projecting cylindrical member with a slot shaped therein to form the locking means. The resulting embodiment turned out to be very advantageous in practice.

Finally according to a preferred embodiment of the invention the cover comprises two substantially identical cover halves hinged along one longitudinal edge to the box body along the opposing longitudinal edge of said box body, and the handle comprises two handle members pivotally hinged to their respective cover halves adjacent the edge of said cover halves opposing the hinging of said cover halves to the box body.

BRIEF DESCRIPTION OF THE DRAWINGS

The invention is described in greater details below with reference to the accompanying drawings, in which.

DESCRIPTION OF PREFERRED EMBODIMENTS

Figure 1A:
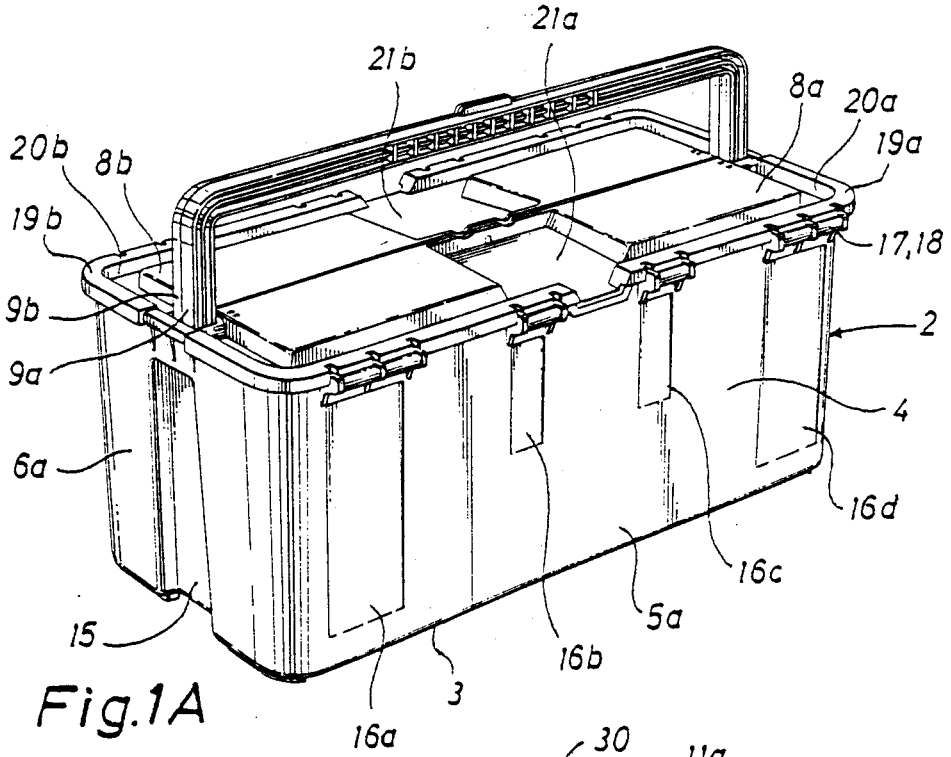
FIGS. 1A and 1B are perspective views of the box.

The box 1 shown in the drawings comprises a box body 2, two cover halves 8a, 8b and a handle member 9a, 9b hinged to each cover half. All the members of the box are made by injection moulding of impact resistant plastics, such as polypropylene, ABS, PVC or polycarbonate or mixtures of one more of said plastics.

Figure 1B:
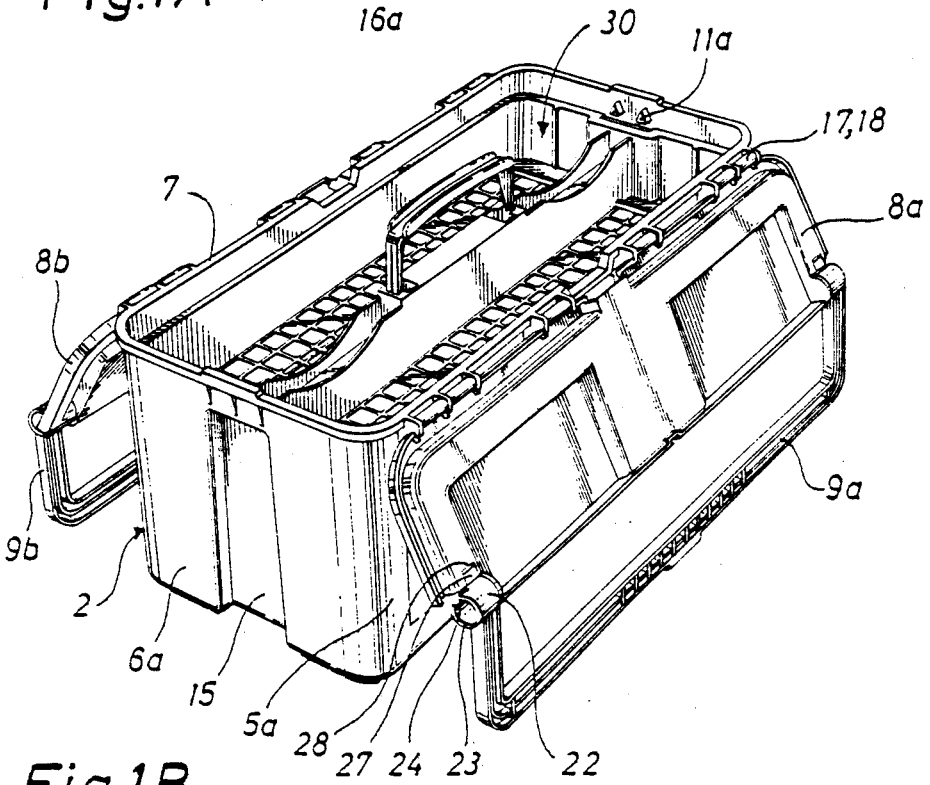

The box body 2 comprises a bottom 3 and a circumferential, upright wall 4. The wall 4 comprises two pairs of opposing wall members 5a, 5b; 6a, 6b, only the end wall 6a and the side wall 5a of said wall members appearing from FIG. 1. The end walls 6a and 6b are provided with a recess 15, and the side walls 5a and 5b are provided with four additional recesses 16a, 16b, 16c, 16d. Each recess 15, 16 terminates a short distance from the upper circumferential rim 7 of the wall 4 where said recesses form a support for a tray not shown and situated inside the box body. The tray rests by its rim on the upper rims of the recesses 15, 16.

The cover halves 8a, 8b are substantially identical. Each cover half is along one longitudinal edge hinged to the adjacent upper edge of the box body by means of joint pins 17 and journals 18, the joint pins being connected to the box body and the journals being connected to the cover half. Each cover half 8a, 8b comprises an edge 19, 19b adapted to rest on the upper rim of the box body 2 when the cover is closed. A recess 20a, 20b extends on the inside of and along the edge 19, 19b, said recess receiving the corresponding handle member 9a, 9b when said member has been turned into a position where it abuts the cover half. Finally, each cover half comprises a central recess 21a, 21b allowing a gripping in the handle member 9a, 9b in question when said member has been turned downwards so as to abut the cover half.

Figure 2:
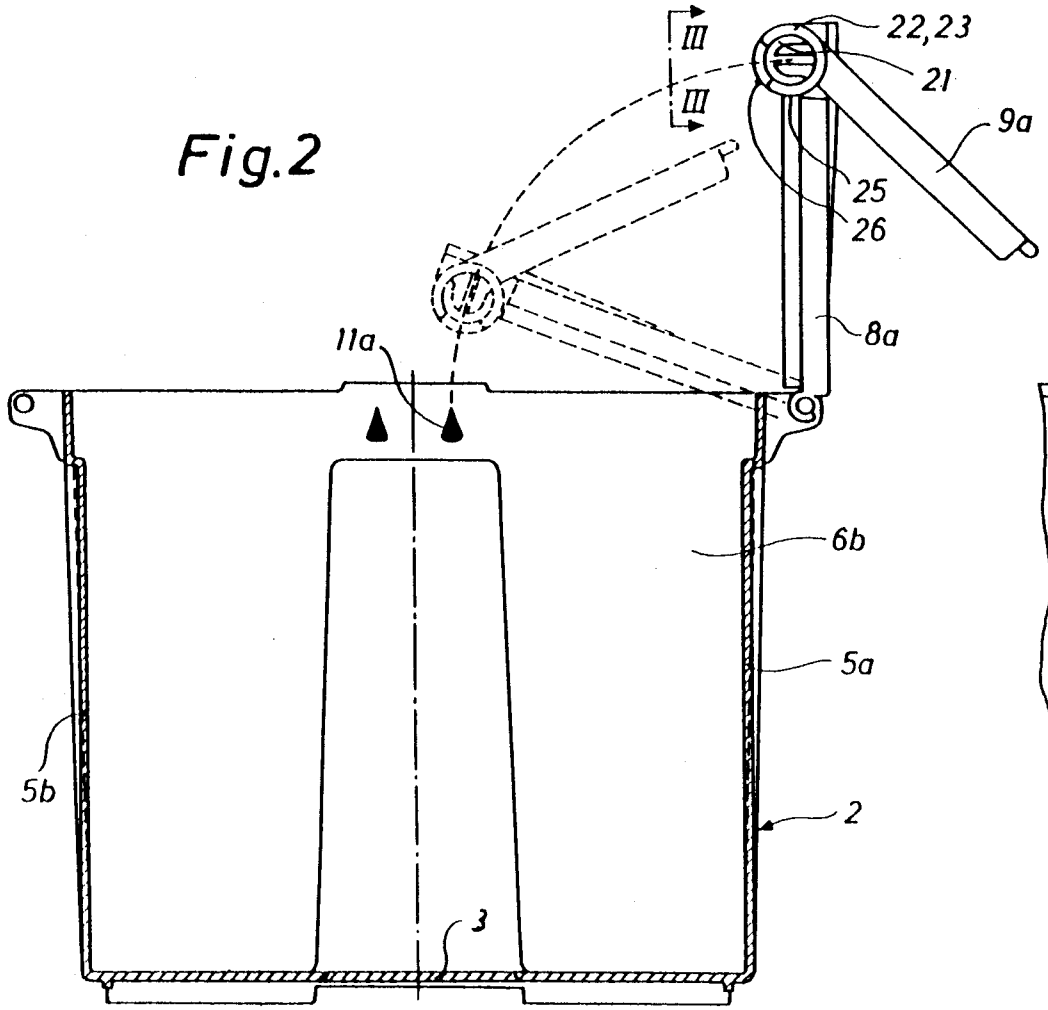
FIG. 2 is an end view, partially in section of the box of FIG. 1.

The handle members 9a, 9b are substantially identical, the reason why only one member will ba described. The handle member is hoop-shaped and hinged to the cover by means of a pivot 21 and a corresponding bearing housing 22, said pivot projecting from each end of the cover and said bearing housing being situated at the corresponding end of the handle member 9a, 9b. As far as the moulding is concerned the pivots 21 are for technical reasons formed like fins, cf. especially FIG. 2. Each bearing housing 22 comprises a locking means formed by a cylindrical extension 23 extending past the outer end of the pivot in question, a radial slot 24 being shaped in said extension. As illustrated in FIG. 2 the slot is situated such that it is perpendicular to the cover half 8a in question when the handle has been turned 45° away from the position in which it abuts the cover half. In this position of the handle member 9a, the locking protrusions 11a can be inserted through the slot 24 and into the cylindrical extension 23 of the bearing housing 22, said locking protrusions being situated on the inside of the opposing end walls 6a, 6b. A cross-sectional view reveals that the locking protrusions 11a are substantially triangular with the point facing upwards, whereby they are easily insertable into the slot 24. In addition the locking protrusions are of a height substantially corresponding to the internal diameter of the cylindrical extension 23.

Figure 3:
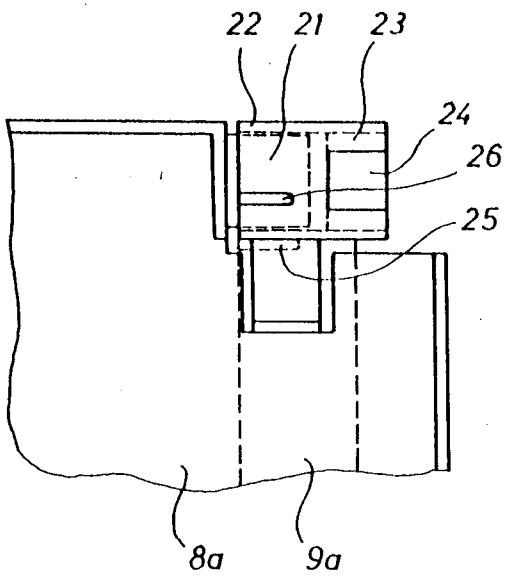
FIG. 3 illustrates a detail seen along the arrow III—III of FIG. 2.

When the handle member 9a is turned after having engaged the corresponding locking protrusions 11a, the handle member 9a and consequently the associated cover half 8a are reliably locked to the box body 2 because said locking protrusions abut the inner surface of the cylindrical extension 23. As a result, the cover halves can only be opened when the associated handle members form the angle of approximately 45° with the horizontal plane, i.e. the cover is locked to the box body 2 both when the box is being carried. i.e. when the handle members are substantially perpendicular to the cover halves, and when said handle members abut the cover halves in question during storage and transport of the box in a car. Each bearing housing 22 is on the outer surface provided with two projections 25, 26, cf, FIG. 3, and in the adjacent portion of the cover half 8a a ratchet means 27 is shaped, said ratchet means being connected to the cover half 8a through a thin-walled portion 28. The outer end of the ratchet means 27 abuts the upper surface of the bearing housing 22 and resists a turning of the projections 25 and 26 of the bearing housing 22 past the ratchet means 27. The first projection 25 is situated corresponding to an angle of rotation of the handle member of approximately 45° relative to the horizontal plane, and the second projection 26 is situated corresponding to the handle member being turned upwards into a vertical position. The first projection 25 is in addition adapted to maintain the handle member in a position of approximately 45° relative to the horizontal plane.

The invention may be varied in many ways without thereby deviating from the scope thereof.

I claim:

1. A portable box comprising a box body including a bottom, a circumferential wall defining at its upper rim an opening, a cover closing the opening as well as a handle means in form of a preferably hoop-shaped handle pivotally hinged relative to the box body and the cover, a locking device being provided in the hinged area of said handle, where said locking device allows an opening or closing of the cover of the box body in a first portion of the turning movement of the handle and in other portions of said turning movement prevents an opening of the cover, wherein the handle (9a, 9b) is pivotally hinged to the cover (8a, 8b), and wherein the locking device comprises two aligned locking protrusions (11a) projecting from their respective opposing wall portion and two aligned locking means (23) associated with the handle (9a, 9b) and situated at their respective end of the cover, said two locking means comprising a hollow interior receiving the corresponding locking protrusion (11a) and further comprising a radial slot (24) allowing an insertion of the locking protrusion (11a) into said locking means (23) when the handle (9a, 9b) is situated in said first portion of its turning movement.

2. A box as in claim 1, wherein the slot (24) of the locking means (23) is shaped such that the corresponding locking protrusion (11a) can be inserted therein when the handle (9a, 9b) has been turned substantially 45° relative to the horizontal plane.

3. A box as in claim 1 or 2, wherein the locking protrusions (11a) are substantially triangular with the point facing upwards when seen in the cross-sectional direction.

4. A box as in claim 1 or 2, wherein the locking means (23) comprises one or more projections (25, 26) on the outside, said projections co-operating with a resilient ratchet means (27) connected to the cover.

5. A box as in claim 1, wherein the handle (9a, 9b) is hinged to the cover (8a, 8b) by means of a pivot (21) projecting from each end of the cover and a corresponding bearing housing (22) at the corresponding ends of the handle (8a, 8b), and wherein each bearing housing (22) comprises an axially projecting cylindrical member with a slot (24) shaped therein to form the locking means (23).

6. A box as in claim 1 or 5, wherein the cover comprises two substantially identical cover halves (8a, 8b) hinged along one longitudinal edge to the box body (2) along the opposing longitudinal edge of said box body, and pivotally hinged to their respective cover halves (8a, 8b) adjacent the edge of said cover halves opposing the hinging of said cover halves to the box body (2).

* * * * *

UNITED STATES PATENT AND TRADEMARK OFFICE

CERTIFICATE OF CORRECTION

PATENT NO. : 4,982,863

DATED : January 8, 1991

INVENTOR(S) : Hans Skillius

It is certified that error appears in the above-identified patent and that said Letters Patent is hereby corrected as shown below:

ON TITLE PAGE: Item [73] should read as follows;

-- A/S E. Damberg Group --

Signed and Sealed this

Thirty-first Day of March, 1992

*Attest:*

HARRY F. MANBECK, JR.

*Attesting Officer*

*Commissioner of Patents and Trademarks*